US008839620B2

(12) United States Patent
Teng et al.

(10) Patent No.: US 8,839,620 B2
(45) Date of Patent: Sep. 23, 2014

(54) SLIDING VANE ROTARY EXPANDER FOR WASTE HEAT RECOVERY SYSTEM

(75) Inventors: Ho Teng, Canton, MI (US); Gerhard Regner, San Diego, CA (US)

(73) Assignee: AVL Powertrain Engineering, Inc., Plymouth, MI (US)

( * ) Notice: Subject to any disclaimer, the term of this patent is extended or adjusted under 35 U.S.C. 154(b) by 395 days.

(21) Appl. No.: 13/143,562

(22) PCT Filed: Jan. 12, 2010

(86) PCT No.: PCT/US2010/020736

§ 371 (c)(1),
(2), (4) Date: Jul. 7, 2011

(87) PCT Pub. No.: WO2010/083153

PCT Pub. Date: Jul. 22, 2010

(65) Prior Publication Data

US 2011/0271674 A1 Nov. 10, 2011

Related U.S. Application Data

(60) Provisional application No. 61/144,248, filed on Jan. 13, 2009.

(51) Int. Cl.

| | |
|---|---|
| ***F01K 23/10*** | (2006.01) |
| ***F01K 23/00*** | (2006.01) |
| ***F01K 23/06*** | (2006.01) |
| ***F01C 20/18*** | (2006.01) |
| ***F01C 21/18*** | (2006.01) |
| ***F01C 1/00*** | (2006.01) |
| ***F01C 1/344*** | (2006.01) |

(52) U.S. Cl.

CPC ..... *F01K 23/10* (2013.01); *F01C 1/3446* (2013.01); *F01K 23/065* (2013.01)

USPC ..... 60/618; 60/614; 60/598; 60/716; 60/670; 418/31; 418/84; 418/173; 418/257

(58) Field of Classification Search

USPC ..... 60/618, 614, 597–598, 716, 670–671, 60/484; 418/178, 257, 259, 173, 260, 266, 418/31, 82

IPC ..... F01C 1/3446; F01K 23/10,23/065; Y02E 20/18

See application file for complete search history.

(56) References Cited

U.S. PATENT DOCUMENTS 2,348,428 A * 5/1944 Tucker ..... 418/173
2,469,510 A * 5/1949 Martinmaas, Jr. ..... 418/265

(Continued)

FOREIGN PATENT DOCUMENTS

DE 3109835 A1 * 9/1982 ..... F02C 2/344
JP 2008143522 6/2008
WO 03033881 A1 4/2003

OTHER PUBLICATIONS

International Preliminary Report on Patentability for International application No. PCT/US2010/020736 mailed Jul. 28, 2011.

(Continued)

*Primary Examiner* — Thai Ba Trieu
(74) *Attorney, Agent, or Firm* — Harness, Dickey & Pierce, P.L.C.

(57) ABSTRACT

A sliding vane rotary expander is used in a waste heat recovery system for a power plant. One example rotary expander has multiple stages with the vane assemblies disposed in bearing supported rings. Another example rotary expander has multiple stages with the vane assemblies disposed in an elliptical cavity. A balance valve equalizes the flow within the stages. Single stage rotary expanders may also be used.

13 Claims, 3 Drawing Sheets

(56) References Cited

U.S. PATENT DOCUMENTS

| | | | | | |
|---|---|---|---|---|---|
| 2,484,337 | A | * | 10/1949 | Ferris | 417/206 |
| 2,658,456 | A | * | 11/1953 | Wahlmark | 418/269 |
| 2,832,199 | A | * | 4/1958 | Adams et al. | 60/484 |
| 2,861,517 | A | * | 11/1958 | Neff | 418/82 |
| 3,187,677 | A | * | 6/1965 | Stieber | 418/156 |
| 3,200,756 | A | * | 8/1965 | Ratliff, Jr. | 418/266 |
| 3,728,048 | A | * | 4/1973 | Ratliff, Jr. | 418/257 |
| 3,807,912 | A | * | 4/1974 | Keller | 418/31 |
| 3,913,351 | A | * | 10/1975 | Edwards | 62/402 |
| 4,018,191 | A | | 4/1977 | Lloyd | |
| 4,021,677 | A | | 5/1977 | Rosen et al. | |
| 4,088,426 | A | * | 5/1978 | Edwards | 418/260 |
| 4,098,256 | A | * | 7/1978 | Sieck | 418/266 |
| 4,120,623 | A | * | 10/1978 | Lohn | 418/173 |
| 4,177,024 | A | * | 12/1979 | Lohn | 418/173 |
| 4,187,694 | A | * | 2/1980 | Midolo | 60/618 |
| 4,300,353 | A | | 11/1981 | Ridgway | |
| 4,351,155 | A | | 9/1982 | Anderson et al. | |
| 4,393,656 | A | * | 7/1983 | Anderson et al. | 60/618 |
| 4,509,906 | A | * | 4/1985 | Hattori et al. | 418/173 |
| 4,514,156 | A | * | 4/1985 | Sakamaki et al. | 418/173 |
| 4,901,531 | A | | 2/1990 | Kubo et al. | |
| 4,996,845 | A | | 3/1991 | Kim | |
| 5,000,003 | A | | 3/1991 | Wicks | |
| 5,064,361 | A | * | 11/1991 | Kristof et al. | 418/173 |
| 5,087,183 | A | * | 2/1992 | Edwards | 418/265 |
| 5,121,607 | A | | 6/1992 | George, Jr. | |
| 5,160,252 | A | * | 11/1992 | Edwards | 418/264 |
| 5,327,987 | A | | 7/1994 | Abdelmalek | |
| 5,385,211 | A | | 1/1995 | Carroll | |
| 5,501,586 | A | * | 3/1996 | Edwards | 418/264 |
| 5,536,153 | A | * | 7/1996 | Edwards | 418/97 |
| 5,680,764 | A | | 10/1997 | Viteri | |
| 6,247,316 | B1 | | 6/2001 | Viteri | |
| 6,450,283 | B1 | | 9/2002 | Taggett | |
| 6,523,349 | B2 | | 2/2003 | Viteri | |
| 6,725,662 | B2 | | 4/2004 | Baba et al. | |
| 6,945,029 | B2 | | 9/2005 | Viteri | |
| 7,056,251 | B2 | | 6/2006 | Ibaraki | |
| 7,181,919 | B2 | | 2/2007 | Uno et al. | |
| 7,454,910 | B2 | | 11/2008 | Hamada et al. | |
| 7,454,912 | B2 | | 11/2008 | Yamanaka et al. | |
| 7,475,541 | B2 | | 1/2009 | Ibaraki et al. | |
| 7,531,912 | B2 | | 5/2009 | Tamura et al. | |
| 2004/0187506 | A1 | | 9/2004 | Iwanami et al. | |
| 2004/0255586 | A1 | | 12/2004 | Hamada et al. | |
| 2005/0228553 | A1 | | 10/2005 | Tryon | |
| 2006/0201154 | A1 | | 9/2006 | Kato et al. | |
| 2007/0126236 | A1 | | 6/2007 | Tamura et al. | |
| 2007/0245737 | A1 | | 10/2007 | Inaba et al. | |
| 2008/0021628 | A1 | | 1/2008 | Tryon | |
| 2008/0027639 | A1 | | 1/2008 | Tryon | |
| 2008/0051977 | A1 | | 2/2008 | Tryon | |
| 2008/0110171 | A1 | | 5/2008 | Schmeltz | |

OTHER PUBLICATIONS

International Search Report and Written Opinion of the International Searching Authority for International application No. PCT/US2010/020736 mailed Mar. 18, 2010.

Freymann, Raymond: Strobl, Wolfgang; Obieglo, Andreas: "The Turbosteamer—A System Introducing the Principle of Cogeneration in Automotive Applications," MTZ 0512008, vol. 69, May 2008, pp. 20-27.

* cited by examiner

SLIDING VANE ROTARY EXPANDER FOR WASTE HEAT RECOVERY SYSTEM

This application claims priority to U.S. Provisional Application No. 61/144,248, which was filed on Jan. 13, 2009.

BACKGROUND

This disclosure relates to a rotary expander for a waste heat recovery system, and in particular, to a sliding vane rotary expander.

Fuel economy can be improved for internal combustion engines by utilizing a waste heat recovery system. One type of waste heat recovery system utilizes a Rankin cycle loop where a working fluid receives heat rejected by an EGR cooler. The recovered waste heat is converted into useful work through an expander and compounded with the engine output through a compounding device, such as an alternator. Typically, the expander greatly influences the overall efficiency of the waste heat recovery system, the power compounding method and system cost.

One type of expander is a rotary expander, which includes sliding vane expanders. The performance of sliding vane expander is typically not very good due to a low pressure expansion ratio relating to its low volumetric efficiency resulting from internal leakage. Increasing rotational speed of a sliding vane expander improves the volumetric efficiency, however, the siding friction of the vanes against its housing also increases leading to deterioration in the mechanical efficiency of the expander.

SUMMARY

An engine waste heat recovery system is disclosed that includes an engine configured to reject heat to a working fluid. A heat exchanger is configured to receive the working fluid. First and second stages respectively include first and second vane assemblies, each having a hub supporting vanes that are radially movable relative to its hub. The first stage includes a high pressure chamber and a first intermediate pressure chamber, and the second stage includes a second intermediate pressure chamber and a low pressure chamber. The high pressure chamber is configured to receive the working fluid from the heat exchanger. The first and second intermediate pressure chambers are fluidly coupled to one another. The first vane assembly is configured to rotate from the high pressure chamber to the first intermediate pressure chamber with the second vane assembly configured to rotate from the second intermediate pressure chamber to the low pressure chamber.

One example rotary expander includes a housing having a cavity. A vane assembly has a hub supporting vanes that are radially movable relative to the hub and in engagement with the cavity. The vane assembly is disposed within the cavity and provides first and second sides, each of the first and second sides providing the first and second chambers. The first chambers are fluidly coupled to one another, and the second chambers are fluidly coupled to one another.

Another example rotary expander includes a housing having a cavity with first and second chambers. A ring is supported within the cavity by a bearing. A vane assembly has a hub supporting vanes that are radially movable relative to the hub and in engagement with the cavity. The vane assembly is disposed within the ring, and the ring is configured to rotate relative to the vanes and the housing.

BRIEF DESCRIPTION OF THE DRAWINGS

The disclosure can be further understood by reference to the following detailed description when considered in connection with the accompanying drawings wherein.

DETAILED DESCRIPTION

Figure 1:
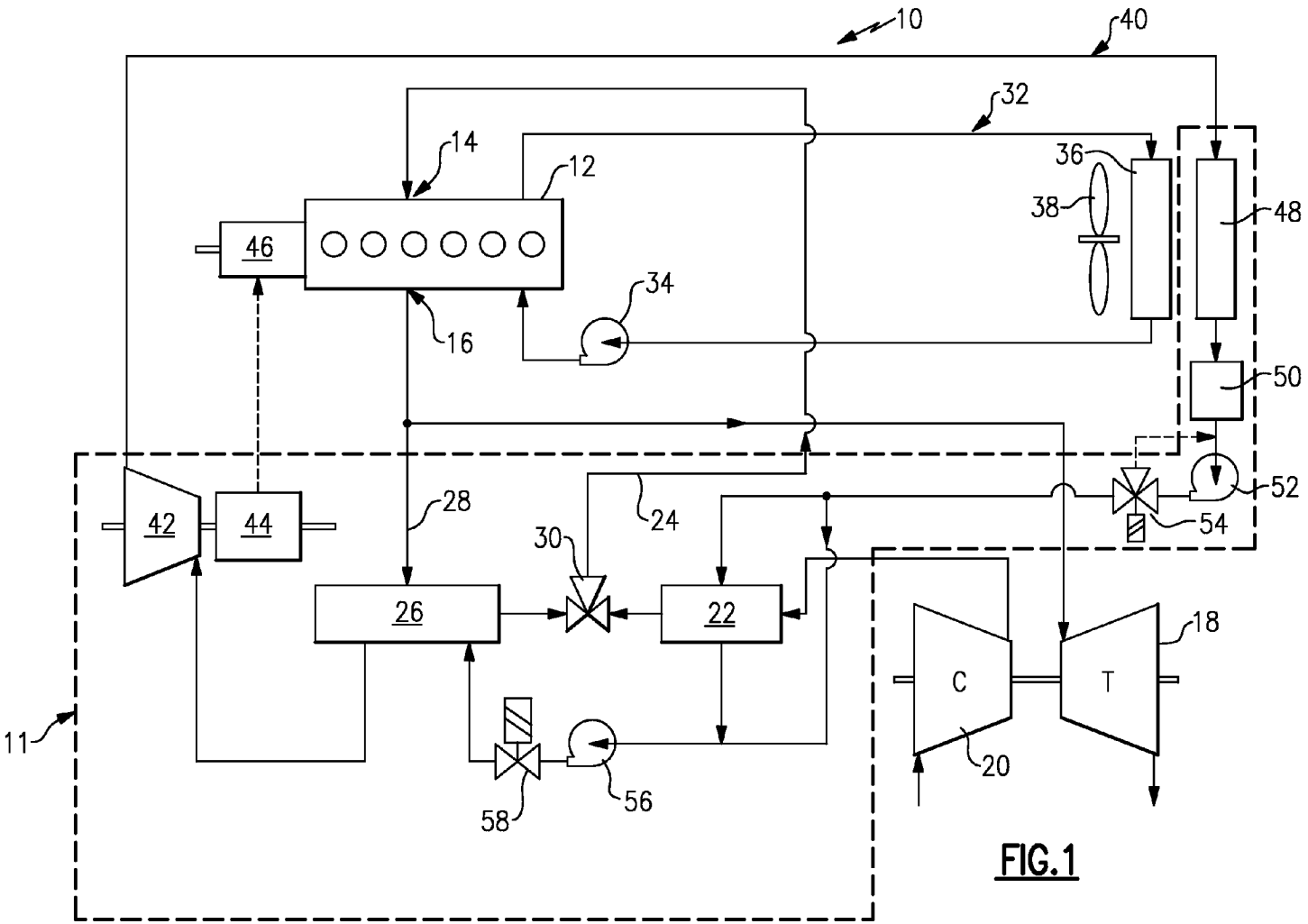
FIG. 1 illustrates an example power plant utilizing an engine waste heat recovery system having a sliding vane expander.

FIG. 1 schematically illustrates an example power plant 10 including an example engine waste heat recovery (WHR) system 11. The power plant 10 includes an engine 12, such as an internal combustion engine, which may be diesel or gasoline. The engine 12 includes an intake system 14 and an exhaust system 16. In the example illustrated, exhaust gases from the exhaust system 16 drive a turbine 18, which in turn rotates a compressor 20 that provides charge air 24 to the intake 14. Compressed air from the compressor 20 may pass through a charge air cooler 22 before entering an EGR mixer 30. The EGR mixer 30 also receives EGR gases 28 cooled by a heat exchanger 26.

A liquid coolant loop 32 receives heat rejected from the engine 12. The example liquid coolant loop 32 includes a pump 34 that circulates the liquid coolant from the engine 12 through a radiator 36 that is cooled by a fan 38.

A working fluid loop 40 circulates a working fluid, such as a water and ethanol mixture, to receive rejected heat from the engine 12, which may be provided through the EGR cooler 26 and/or other sources. The working fluid loop 40 includes a sliding vane expander 42 fluidly coupled to the heat exchanger 26. The working fluid rotationally drives the sliding vane expander 42, which in turn rotates a compounding device 44, such as an alternator, which is operationally coupled to a drive member 46 connected to the engine 12. The drive member may be an electric motor, for example. In this manner, waste heat gathered by the engine heat recovery system 11 supplements the power provided by the engine 12.

In the example illustrated, the working fluid loop 40 includes a condenser 48 that receives the expanded working fluid from the sliding vane expander 42. Condensed working fluid is collected in a reservoir 50, which is circulated by a low pressure pump 52. The pressure of the working fluid from the low pressure pump 52 is regulated by a flow control device 54. A high pressure pump 56 receives the working fluid, a portion of which may pass through the charge air cooler 22, and supplies the working fluid to the heat exchanger 26 through a pressure regulator 58.

Figure 2:
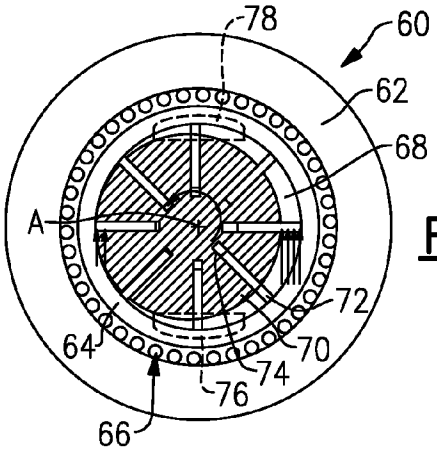
FIG. 2 is one example sliding vane expander according to the disclosure.

In one example, the sliding vane expander 42 is provided by an expander assembly 60, as illustrated in FIG. 2. The expander assembly 60 includes a housing 62 receiving a ring 64 supported by a bearing 66. In one example, the bearing 66 is a needle bearing. The ring 64 provides a cavity 68 within which a hub 70 is disposed. Multiple vanes 72 are received in slots 74 circumferentially arranged about the hub 70. The vanes 72 slidably move radially inwardly and outwardly to maintain engagement with an inner surface of the ring 64 as the hub 70 is rotated about its axis A. Biasing members may be provided in the slots 74 to urge the vanes 72 outward. The hub 70 is disposed to one side of the cavity 68 to provide a pumping chamber with which first and second chambers 76, 78 are in fluid communication. The high pressure working fluid from the heat exchanger 26 enters the first chamber 76 and expands, rotationally driving the hub 70 and its shaft 71 in a counterclockwise direction, before being expelled through the second chamber 78.

Figure 3:
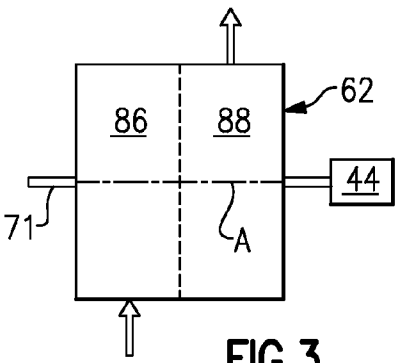
FIG. 3 schematically illustrates a multi-stage expander assembly utilizing the expander illustrated in FIG. 2.
Figure 4:
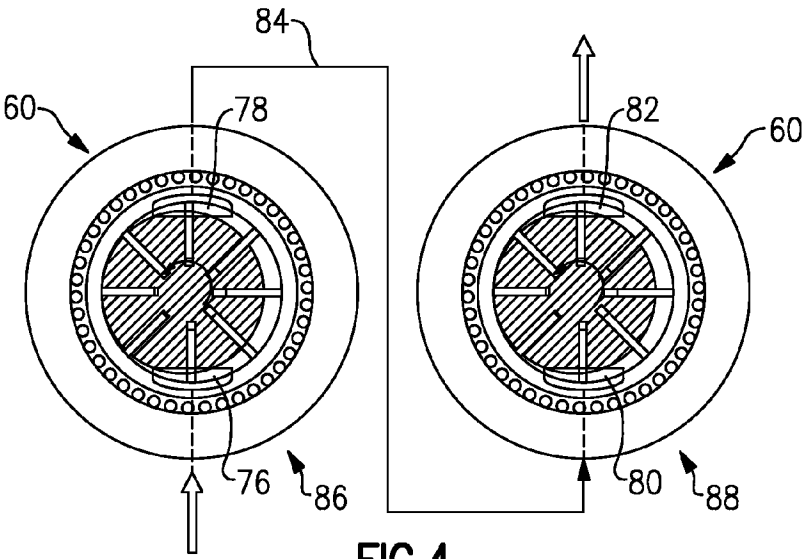
FIG. 4 illustrates the multi-stage expander shown in FIG. 3 in more detail.

The expander assembly 60 may be used for multiple stages in a multi-stage arrangement, as illustrated in FIGS. 3 and 4. In this example, the first chamber 76 corresponds to a high pressure chamber, and the second chamber 78 corresponds to an intermediate pressure chamber. The intermediate pressure chamber 78 of the first stage 86 is fluidly coupled to an intermediate chamber 80 of the second stage 88 via a fluid circuit 84. The second stage 88 includes a low pressure chamber 82.

In the example, the expander assemblies 60 of the first and second stages 86, 88 are disposed within a common housing 62 and supported on a common shaft 71 for rotation together about an axis A. A housing wall separates the cavities of the first and second stages 86, 88.

Figure 5:
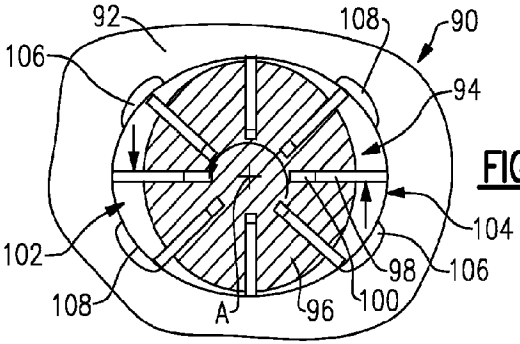
FIG. 5 is another example sliding vane expander according to the disclosure.

In another example, the sliding vane expander 42 is provided by expander assembly 90, as illustrated in FIG. 5. The expander assembly 90 includes a housing 92 providing an elliptical cavity 94. A hub 96 is disposed within the cavity 94 generally centrally relative thereto. The hub 96 includes multiple vanes 98 disposed in slots 100 arranged circumferentially about the hub 96. The vanes 98 slidably move radially inwardly and outwardly to maintain engagement with the inner surface of the cavity 94 during rotation. The hub 96 separates the cavity 94 into first and second sides 102, 104. Each of the first and second sides 102, 104 includes first and second chambers 106, 108. The first chamber 106 receives high pressure working fluid from the heat exchanger 26. The high pressure working fluid rotates the hub 96 counterclockwise about its axis A and is expelled out the second chamber 108.

Figure 6:
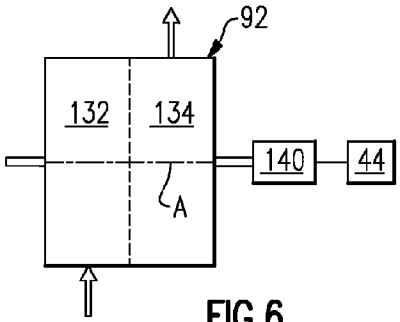
FIG. 6 schematically illustrates a multi-stage expander assembly utilizing the expander illustrated in FIG. 5.
Figure 7:
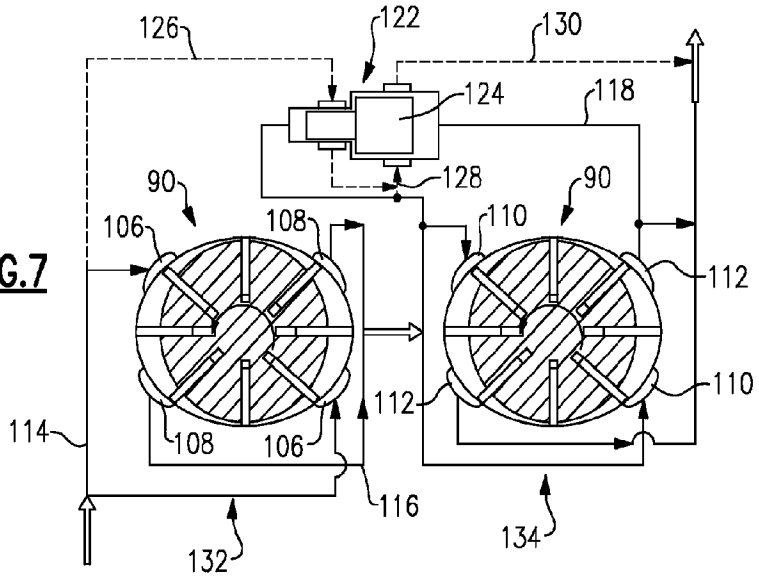
FIG. 7 illustrates the multi-stage expander shown in FIG. 6 in more detail.

A multi-stage expander assembly is shown in FIGS. 6 and 7. In one example, a expander assembly 90 is arranged in each of first and second stages 132, 134. The first chambers 106 of the first stage 132 are fluidly coupled by a first fluid circuit 114. The second chambers 108 of the first stage 132 are fluidly coupled to third chambers 110 via a second fluid circuit 116. The first and second circuits 114, 116 respectively correspond to high pressure working fluid and intermediate pressure working fluid. The intermediate pressure working fluid from the third chambers 110 of the second stage 134 is expelled to the third fluid circuit 118 through the fourth chambers 112.

There may be some instances in which the flows through the first and second stages 132, 134 are not in balance due to either unequal wear of the vanes 98 or upstream or downstream pressure fluctuations. In such a situation, a balance valve 122 may be used, which is shown schematically in FIG. 7. In one example, the balance valve 122 includes a piston 124 upon which fluid from first, second and third balance circuits 126, 128, 130 acts. The first, second and third balance circuits 126, 128, 130 are fluidly coupled respectively to the first, second and third fluid circuits 114, 116, 118. If the flow of the second stage 134 is greater than the first stage 132, then the low pressure working fluid is greater than the balance condition. In this case, the balance valve opens the bypass port on the third circuit 130 to reduce the inlet pressure for the second stage 134, which reduces the flow driving force for the second stage 134. If the flow of the first stage 132 is greater than the second stage 134, then the intermediate working pressure is greater than the balance condition. In this case, the balance valve opens the second circuit 128 to increase the intermediate pressure, which reduces the flow of the first stage 132 and increases the flow of the second stage 134. With this flow balance valve 122, the flow through the first and second stages 132, 134 of the expander can be balanced to a reasonable degree.

If the rotary expander 90 is to drive an alternator, for example, then the two stage configuration illustrated in FIGS. 6 and 7 may not meet the speed requirement of the alternator. For such applications, a gearbox 140 may be arranged between the rotary expander and the compounding device 44.

Although an example embodiment has been disclosed, a worker of ordinary skill in this art would recognize that certain modifications would come within the scope of the claims. For that reason, the following claims should be studied to determine their true scope and content.

What is claimed is:

1. An engine waste heat recovery system comprising:

an engine configured to reject heat to a working fluid;

a heat exchanger configured to receive the working fluid;

first and second stages respectively including first and second vane assemblies each having a hub supporting vanes radially movable relative to its hub, the first stage including a high pressure chamber and a first intermediate pressure chamber, and the second stage including a second intermediate pressure chamber and a low pressure chamber, the high pressure chamber configured to receive the working fluid from the heat exchanger, the first and second intermediate pressure chambers fluidly coupled to one another, the first vane assembly configured to rotate from the high pressure chamber to the first intermediate pressure chamber with the second vane assembly configured to rotate from the second intermediate pressure chamber to the low pressure chamber; and a balance valve operable to balance flow through the first stage and the second stage by selectively increasing or decreasing flow of the working fluid to the second intermediate pressure chamber.

2. The engine waste heat recovery system according to claim 1, wherein the hubs are operatively coupled by a shaft.

3. The engine waste heat recovery system according to claim 2, wherein the hubs are fixed relative to one another and disposed within a common housing.

4. The engine waste heat recovery system according to claim 3, wherein each stage includes a ring in the housing supported by a bearing, a respective vane assembly disposed in the ring, the ring rotatable relative to its respective vanes and the housing.

5. The engine waste heat recovery system according to claim 3, wherein each vane assembly includes first and second sides, the first stage first and second sides each providing the high pressure chamber and the first intermediate pressure chamber, and the second stage first and second sides each providing the second intermediate pressure chamber and the low pressure chamber, the high pressure chambers fluidly coupled to one another, the first and second intermediate pressure chambers fluidly coupled to one another, and the low pressure chambers fluidly coupled to one another.

6. The engine waste heat recovery system according to claim 5, wherein the housing provides first and second elliptical cavities within which the first and second vane assemblies are respectively disposed, each vane assembly separating its respective elliptical cavity into the first and second sides.

7. The engine waste heat recovery system according to claim 5, comprising a gearbox operatively coupled to the shaft and configured to provide an output speed greater than a rotational speed of the shaft.

8. The engine waste heat recovery system according to claim 2, comprising a compounding device operatively coupled between the shaft and the engine and configured to supplement a power of the engine.

9. The engine waste heat recovery system according to claim 1, wherein the balance valve includes a piston upon which balance fluid from at least one balance circuit acts, the balance fluid operable to selectively move the piston between a first state reducing pressure of the working fluid at the second intermediate pressure chamber and a second state increasing pressure of the working fluid at the second intermediate pressure chamber.

10. A rotary expander for a power plant having an engine and a heat exchanger that receives rejected heat from the engine, the rotary expander comprising:

a housing having a cavity;

a first vane assembly having a first hub supporting vanes radially movable relative to the first hub and engaging the cavity, the vane assembly disposed within the cavity and providing the cavity with a first side having a first chamber and a second chamber and a second side having a third chamber and a fourth chamber, the first chamber and the third chamber receiving high pressure working fluid from the heat exchanger and being fluidly coupled to one another, the second chamber and the fourth chamber expelling the working fluid respectively received from the first chamber and the third chamber from the cavity; and a second vane assembly disposed within a second cavity in the housing, the second vane assembly having a second hub supporting second vanes radially movable relative to the second hub and engaging the second cavity, the second vane assembly providing the second cavity with a first side having a fifth chamber and a sixth chamber and a second side having a seventh chamber and an eighth chamber, the fifth chamber and the seventh chamber receiving the working fluid from the second chamber and the fourth chamber and being fluidly coupled to one another, the sixth chamber and the eighth chamber expelling the working fluid respectively received from the fifth chamber and the seventh chamber from the second cavity.

11. The rotary expander according to claim 10, wherein the cavity is elliptical in shape, and the first vane assembly is disposed generally centrally within the cavity.

12. The rotary expander according to claim 10, further comprising a balance valve in fluid communication with the vane assembly and the second vane assembly, the balance valve operable to balance flow through the first vane assembly and the second vane assembly by selectively increasing or decreasing flow of the working fluid to the second vane assembly.

13. The rotary expander according to claim 10, wherein the first hub and second hub are operatively coupled by a shaft.

* * * * *

UNITED STATES PATENT AND TRADEMARK OFFICE

CERTIFICATE OF CORRECTION

PATENT NO. : 8,839,620 B2
APPLICATION NO. : 13/143562
DATED : September 23, 2014
INVENTOR(S) : Teng et al.

It is certified that error appears in the above-identified patent and that said Letters Patent is hereby corrected as shown below:

In the Claims

Column 5,
line 26 Claim 10 before "vane" insert -- first --.

Column 6,
line 24 Claim 12 before "vane" insert -- first --.

Signed and Sealed this
Tenth Day of February, 2015

Michelle K. Lee

Michelle K. Lee
*Deputy Director of the United States Patent and Trademark Office*